US006938325B2

(12) United States Patent
Tanielian

(10) Patent No.: US 6,938,325 B2
(45) Date of Patent: Sep. 6, 2005

(54) METHODS OF FABRICATING ELECTROMAGNETIC META-MATERIALS

(75) Inventor: Minas H. Tanielian, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 79 days.

(21) Appl. No.: 10/356,934

(22) Filed: Jan. 31, 2003

(65) Prior Publication Data

US 2004/0151876 A1 Aug. 5, 2004

(51) Int. Cl.[7] ..... H01F 7/06; B05D 5/12

(52) U.S. Cl. ..... 29/602.1; 29/417; 29/846; 427/128; 427/209; 336/184; 336/200; 336/205

(58) Field of Search ..... 29/602.1, 412, 29/417, 846, 609, 831; 427/128, 131, 209; 336/184, 200, 205, 221, 232

(56) References Cited

U.S. PATENT DOCUMENTS 3,812,442 A * 5/1974 Muckelroy ..... 29/602.1 X

FOREIGN PATENT DOCUMENTS

JP 2000-286132 * 10/2000

OTHER PUBLICATIONS

S. A. Tretyakov, "Meta–Materials with Wideband Negative Permittivity and Permeability," Microwave and Optical Technology Letters, vol. 31, No. 3, Nov. 5, 2001, Radio Laboratory, Helsinki University of Technology, FIN–02015 HUT, Finland. The original version was published in Russian in 1967, not in 1964, as stated in English translation.

V. G. Veselago, "The Electrodynamics of Substances with Simultaneously Negative Values of E and β," Soviet Physics USPEKH1 10, 509–514 (1968).

J. B. Pendry, A. J. Holden, D. J. Robbins, W. J. Stewart, "Magnetism from Conductors and Enhanced Nonlinear Phenomena," IEEE Transactions on Microwave Theory 47 (1999) 2075.

D. R. Smith, W. Padilla, D. C. Vier, S. C. Nemat–Nasser, and S. Schultz, "Composite Medium with Simultaneous Negative Permittivity and Permeability," Phys. Rev. Lett., 84, 4184–4187 (2000).

D.R. Smith, "Experiments and Simulations on Left–handed Metamaterials," presented at the Progress in Electromagnetic Research Symosium, Jul. 2, 2002, Royal Sonesta Hotel, Boston, MA.

R. A. Shelby, D. R. Smith, S. C. Nemat–Nasser and S. Schultz, "Microwave Transmission Through a Two Dimensional, Isotropic, Left–Handed Metamaterial," Submitted to Applied Physics Letters, Oct. 23, 2000.

R. A. Shelby, D. R. Smith, and S. Schultz, "Reversal of Snell's Law: Experimental Verification of Negative Refraction," (Submitted to Science: Jan. 5, 2001).

* cited by examiner

*Primary Examiner*—A. Dexter Tugbang
(74) *Attorney, Agent, or Firm*—Black Lowe & Graham, PLLC

(57) ABSTRACT

In one embodiment, a method for fabricating electromagnetic meta-materials includes applying first and second array of electromagnetically reactive patterns to first and second non-conducting surfaces, wherein the first array includes at least one of a split ring resonator pattern, a square split ring resonator pattern, and a swiss roll pattern, and the second array includes a thin parallel wire pattern. The first and second non-conducting surfaces are joined together such that the first and second non-conducting surfaces bearing the first and second arrays of electromagnetically reactive patterns are commonly oriented. Alternately, a method may further include slicing between elements of the first and second arrays of electromagnetically reactive patterns in a plane perpendicular to the first and second surfaces to form a plurality of slices, rotating at least one of the slices, and applying a third array of electromagnetically reactive patterns to a third non-conducting surface.

25 Claims, 12 Drawing Sheets

METHODS OF FABRICATING ELECTROMAGNETIC META-MATERIALS

NOTICE OF GOVERNMENT RIGHTS

This invention was made with Government support under Contract MDA972-01-2-0016 awarded by DARPA. The Government has certain rights in this invention.

FIELD OF THE INVENTION

This invention relates generally to a method for producing electromagnetic materials, and, more specifically, to producing electromagnetic meta-materials with selected magnetic and electric properties.

BACKGROUND OF THE INVENTION

Conventionally, electric and magnetic fields follow what is termed as the right-hand rule: an electrical current flowing through a conductor results in a magnetic flux revolving around the conductor in a clockwise direction as observed from the direction of the source of the current. This is termed the right-hand rule because, while extending the thumb of one's right hand, the direction one's fingers curl indicates the direction in which induced magnetic flux revolves. However, as originally termed by V. G. Veselago, "left-handedness" can exist. In other words, a material can exist in which the flow of the electric current causes magnetic flux of an opposite sense, revolving in a counter-clockwise direction from the perspective of the source of the current.

More specifically, conventional, right-handed materials have positive values of electric permittivity, $\in$, and magnetic permeability, $\mu$. Therefore, as shown in FIG. 1, if ranges of electric permittivity and magnetic permeability are graphed in a two-dimensional Cartesian space 100, the properties of natural materials fall in a first, upper-right quadrant 110 of the graph 100. On the other hand, left-handed materials or meta-materials have negative values of both electric permittivity and magnetic permeability. As a result, these quantities describing left-handed materials fall in a third, lower-left quadrant 120 of the graph 100.

Left-handed materials can have useful properties in manipulating electromagnetic signals, for example, in refracting those signals. As shown in FIG. 2, an electromagnetic signal 200 passing from a first right-handed material 210 into a second right-handed material 220 at a boundary 230 will always be refracted toward the normal 240 of the boundary 230. This is because the index of refraction n for such signals derived from Snell's law is always a positive quantity. According to Snell's law, the index of refraction n can be derived from the equation $n^2=\in\mu$. Therefore, $n=\sqrt{\in\mu}$, conventionally, necessarily yields a positive quantity. Because n is a positive quantity, as is understood by one ordinarily skilled in the art, the electromagnetic signal 200 always is refracted toward the normal 240. However, as suggested by Veselago, if the electric permittivity $\in$ and magnetic permeability $\mu$ are both negative numbers, then the square root of the combined quantity will yield a negative number. Thus, as shown in FIG. 3, because the index of refraction can be a negative quantity, a signal 300 passing from a right-handed material 310 into a left-handed material 320 at a boundary 330 is refracted away from the normal 340.

A material exhibiting such refractive properties, to name one example, would be useful in allowing different ways of focusing electromagnetic signal transmission and reception, such as in radar. Antennae or electromagnetic lenses incorporating left-handed materials for the transmission and reception of such signals could be shaped differently than devices constructed of only right-handed materials. However, left-handed materials are only theorized, and currently there are no methods for fabricating left-handed materials. Therefore, there is an unmet need in the art for a method to fabricate left-handed materials, as well as for the materials such a method can produce.

SUMMARY OF THE INVENTION

The present invention provides a method for producing meta-materials whose electric permitivities and magnetic permeabilities can conform to a left-hand rule and the meta-material produced thereby. Using conventional substrates and conductive materials, layered or composite meta-materials can be constructed with controllable, desired negative values or electric permittivity and magnetic permeability. A substrate is provided on which a final product will reside or merely will support thin-layered materials during their creation. On the substrate, patterns of a conductive material are applied to create a layer of cells with the desired properties. The substrates, bearing these patterns, then can be joined together, and sliced perpendicular to the applied patterns, rotating these slices to provide a substrate for the next layer of patterns of conductive materials. This process is repeated until three dimensions of faces have had patterns of conductive material applied to them.

For example, an embodiment of a method of the present invention provides a suitably conventional substrate material. An array of electromagnetically reactive patterns of a conductive material is applied to a first face of a set of substrate materials. Once the array of electromagnetically reactive patterns have been applied to the first face of a set of substrates, each of the respective substrates are joined together with or without suitable spacers between the substrates. Through this process, the faces bearing the electromagnetically reactive pattern are commonly oriented, so that each face is aligned in the same direction, thus creating a one-dimensional block of left-handed material. The substrate block is subsequently sliced between elements of the array of electromagnetically reactive patterns and in a plane perpendicular to a face to which the electromagnetically reactive patterns were applied. The slicing process creates a new set of substrates on which suitable patterns can be applied after they are rotated by ninety degrees. Again, this new set of substrates can be joined together with or without suitable spacers to form a two-dimensional block of left-handed material. This is followed by yet one more slicing process similar to the one used for the creation of the two-dimensional block. Again, suitable electromagnetic patterns are applied to the ninety-degree-rotated slices, followed by a joining process to create a three-dimensional meta-material block.

If desired, embodiments of the present invention also suitably involve applying a binding material to each face of the substrate, then applying the conductive patterns to the binding material. An additional layer of binding material may then be applied over the conductive patterns. The presence of the binding material allows for different presentation of the patterns of conducive material. An etching material corrosive of the substrate may be applied to formed three-dimensional meta-materials to dissolve the substrate and leave a honeycombed mass of the conductive patterns supported by a lattice of the binding material. Similarly, the binding material could be removed from the substrate and/or separated to create a plurality of cells which can be arranged in a solid form. Also, embodiments of the present invention include multi-dimensional meta-materials having electromagnetically reactive elements arrayed in at least two dimensions supported by a supporting structure.

BRIEF DESCRIPTION OF THE DRAWINGS

The preferred and alternative embodiments of the present invention are described in detail below with reference to the following drawings.

DETAILED DESCRIPTION OF THE INVENTION

FIGS. 4A, 4B, 4C, and 4D show four different patterns for depositing conductive materials upon layers of substrate that may be used in the preparation of meta-materials—that is, materials exhibiting negative values of electric permittivity and magnetic permeability. The patterns, used individually or in combination in the presence of an excitation wave, can be electromagnetically reactive.

Figure 1:
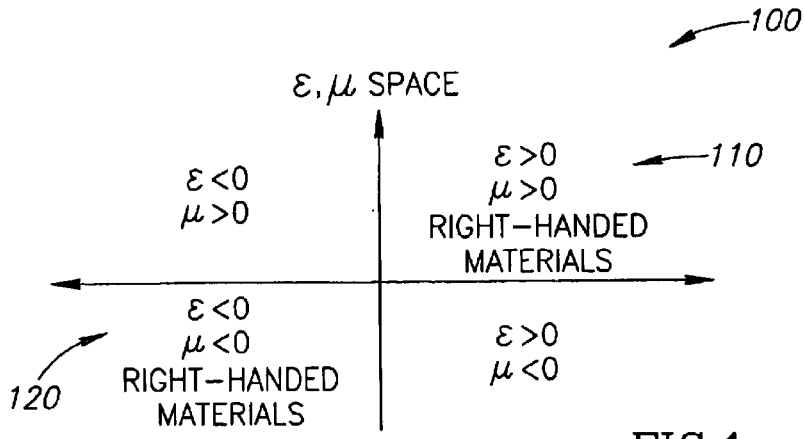
FIG.1 (PRIOR ART)
FIG. 1 is a prior art graph showing relative positions occupied by materials having positive and negative magnetic permeabilities and electric permitivities.
Figure 2:
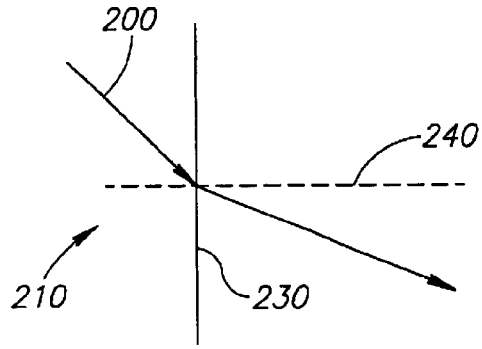
FIG.2 (PRIOR ART)
FIG. 2 is a prior art diagram showing refraction of an electromagnetic signal from a material observing a right-hand rule to another material observing the right-hand rule.
Figure 3:
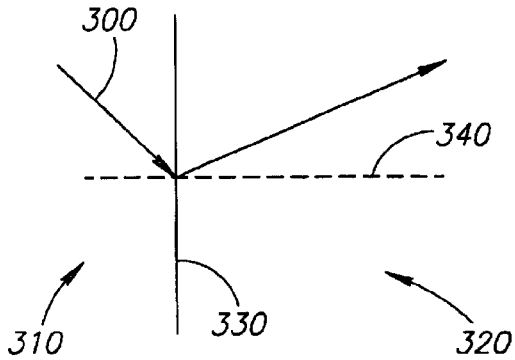
FIG.3 (PRIOR ART)
FIG. 3 is a prior art diagram showing the refraction of an electromagnetic signal from a material observing a right-hand rule to a material observing a left-hand rule.
Figure 4A:
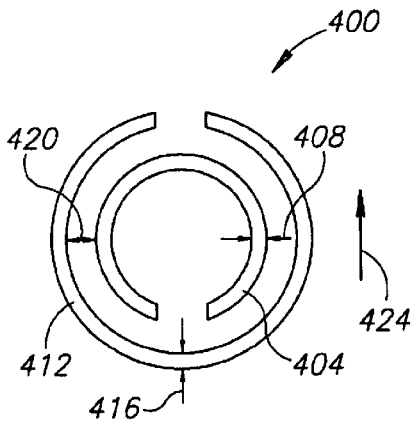
FIG. 4A is a split ring resonator (SRR) pattern of a deposit of conductive material used in accordance with embodiments of the present invention.

FIG. 4A shows a split ring resonator pattern (SRR) 400. The split ring resonator pattern 400 includes an inner ring 404 having a width 408 and an outer ring 412 having a width 416. The rings 404 and 412 are separated by a gap 420. The split ring resonator pattern 400 has an orientation 424. Similar to the split ring resonator pattern 400 of FIG. 4A is a square split ring resonator pattern 430 (SSRR) of FIG. 4B. The square split ring resonator pattern 430 includes an inner ring 434 having a width 438 and an outer ring 442 having a width 446. The rings 434 and 442 are separated by a gap 450. The square split ring resonator pattern 430 has an orientation 454.

Figure 4B:
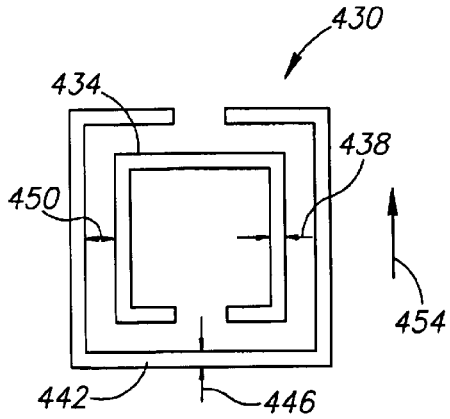
FIG. 4B is a square split ring resonator (SSRR) pattern of a deposit of conductive material used in accordance with embodiments of the present invention.
Figure 4C:
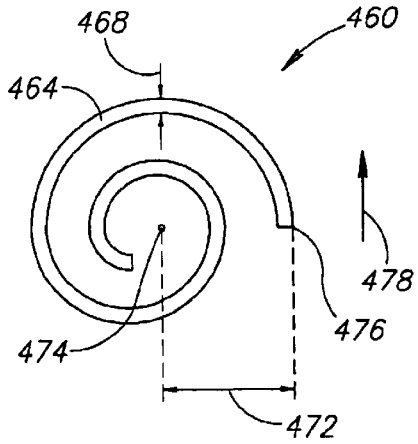
FIG. 4C is a swiss roll (SR) pattern of a deposit of conductive material used in accordance with embodiments of the present invention

FIG. 4C shows a swiss roll pattern (SR) 460. The swiss roll pattern 460 includes a continuous, winding loop 464 having a width 468. The swiss roll pattern 460 has a radius 472 as measured from a centerpoint 474 to an outer edge 476. The swiss roll pattern 460 also is described by a number of turns the loop 464 makes about the centerpoint. In the swiss roll pattern 460 shown, the loop 464 makes one and three-quarters turns about the centerpoint. The swiss roll pattern 460 has an orientation 478.

Figure 4D:
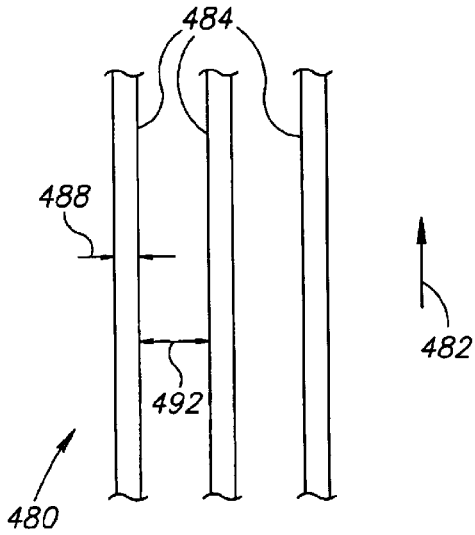
FIG. 4D is a thin parallel wire (TPW pattern) of a deposit of conductive material used in accordance with embodiments of the present invention.

FIG. 4D shows a thin parallel wire pattern (TPW) 480. The thin parallel wire pattern 480 is so called because the thin parallel wire pattern 480 includes a plurality of parallel wire elements 484. Each wire element 484 of the thin parallel wire pattern 480 has a width 488 and is suitably separated from other elements 484 by a gap 492. The thin parallel wire pattern 480 has an orientation 482.

Applying an excitation wave to one or more split ring resonator, square split ring resonator, or swiss roll patterns results in a negative effective magnetic permeability caused by the pattern's resonant reaction to the energy. On the other hand, the presence of a wire element creates a negative effective electrical permittivity in a given frequency range. Advantageously, the combination of these patterns, therefore, results in a left-handed material or meta-material in a given frequency range. For example, at a field resonance of about 4.86 gigahertz, a negative effective magnetic permeability and electric permittivity can be measured in a split ring resonator pattern having a depth of about 0.52 millimeters, an inner ring 404 having an inner radius of about 0.8 millimeters, an inner ring width 408 and an outer ring width 416 of about 1.5 millimeters, an interring gap 420 of about 0.2 millimeters, a wire thickness of about 0.4 millimeters, and a gap between a wire element 484 and the split ring resonator pattern 400 of about 0.4 millimeters. Orientation of the split ring resonator pattern 400 or other patterns relative to that of the thin wire pattern 480 is described below.

Additionally, manipulating the form of these patterns can change the electromagnetic properties of devices in which they are installed. For one example, for a SRR pattern 400, changing the width 408 of the inner loop 404, the width 416 of the outer loop 412, or the gap 420 between loops 404 and 412 affects the pattern's electromagnetic properties. In addition, ferromagnetic material might be inlaid inside a central area bounded by the inner loop 404 of the SRR pattern 400, the inner loop 434 of the SSRR 430 pattern, or around the centerpoint 474 of the SR pattern 460. Inclusion of such materials can change the magnetic permeability of the structure when exposed to a magnetic field.

Figure 5:
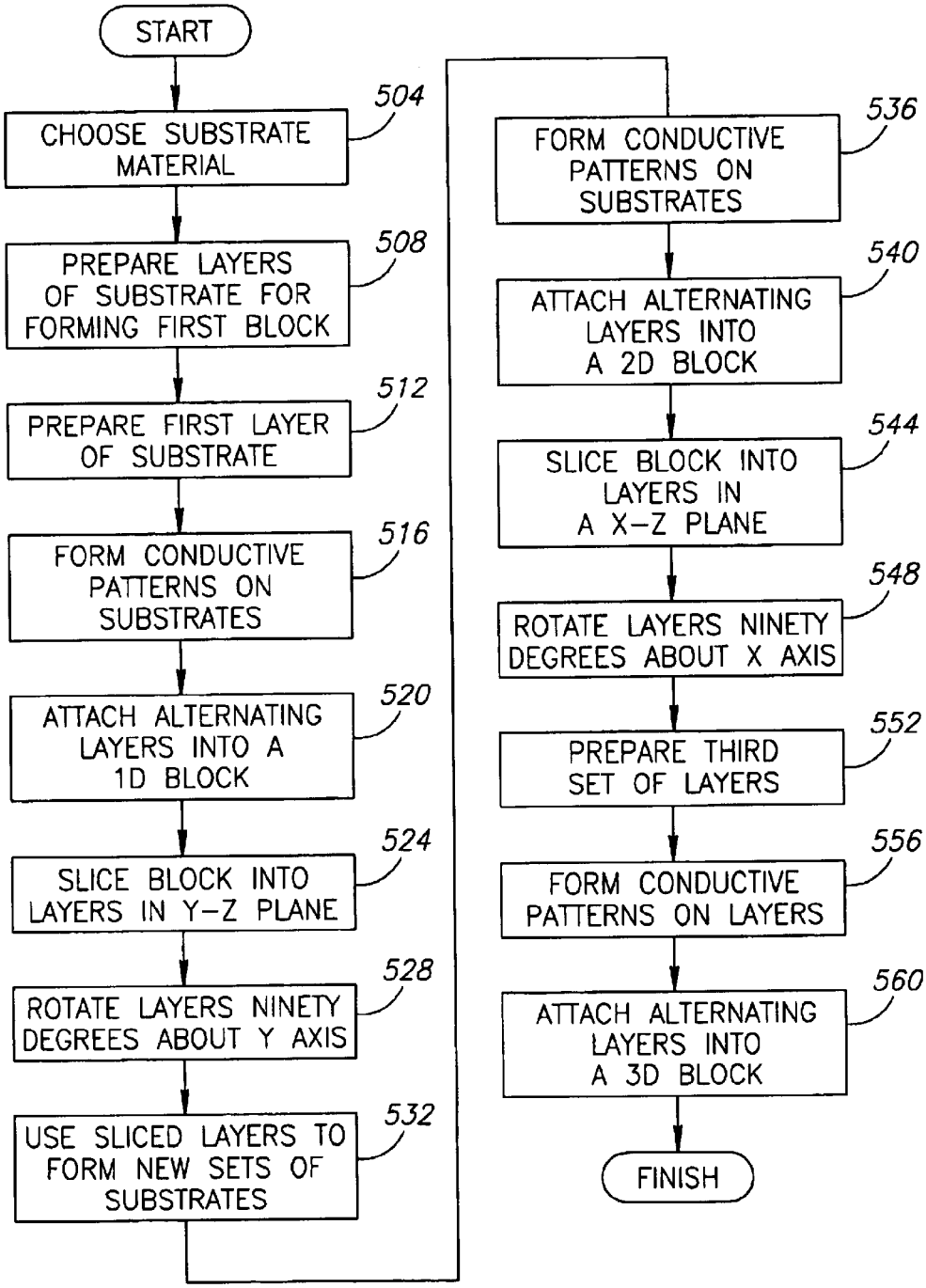
FIG. 5 is a flowchart of a method for making meta-materials in accordance with a first embodiment of the present invention.

Making use of the patterns 400, 430, and 460, different forms of the meta-materials are created. FIG. 5 is a flowchart of a method for making meta-materials in accordance with a first embodiment of the present invention, and FIGS. 6A through 6I show perspective views of meta-materials being created thereby. The method begins at a block 504 by choosing a substrate material. The choice of substrate is open, and can be made based upon numerous design considerations to take advantage of widely different properties of each material that might prove advantageous. For example, plastics, such as Teflon, polystyrene, or polycarbonate, or ceramics, quartz, glass, polymide may be used. Having chosen the substrate at the block 504, at a block 508 the substrate is prepared in layers. At a block 512, any preparatory steps desired for forming a suitable spacer material, which could be the same nonconductive material chosen for the substrate or a different nonconductive material, depending on the properties desired. The properties desired can be determined based on simulation results using standard solutions of Maxwell's equations.

At a block 516, patterns of conductive materials are formed on the layers of the substrate. As will be understood by one ordinarily skilled in the art, the patterns of conductive material are suitably formed first by depositing conductive materials on the substrate layers using thin film deposition, lamination of a copper sheet, or some other technique known by those ordinarily skilled in the art. Once the conductive materials have been deposited, the material not being used is etched away using standard micro-photolithography, etching, or other techniques. The conductive material is etched away to leave patterns may include SRR patterns 400 (FIG. 4A), SSRR patterns 430 (FIG. 4B), SR patterns 460 (FIG. 4C), and/or thin parallel wire patterns 480 (FIG. 4D). Alternatively, a "direct write" technique can also be used to form the patterns.

Figure 6A:
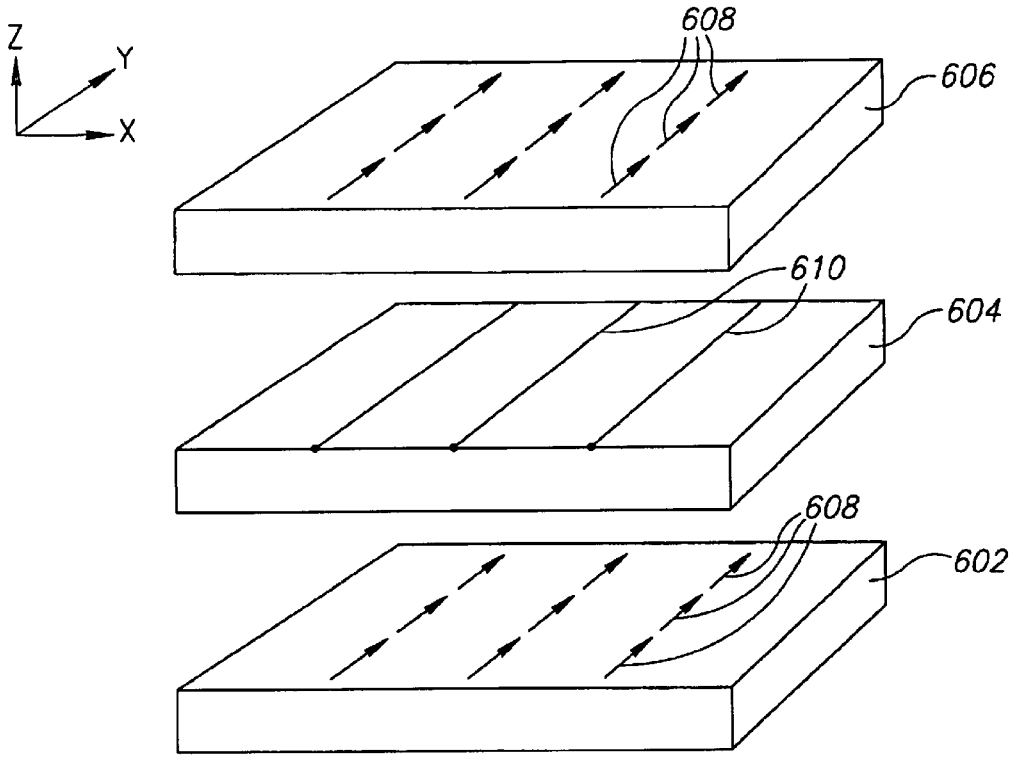
FIG. 6A is a perspective view of patterns of conductive material applied to layers of a substrate in accordance with a first embodiment of the present invention.

FIG. 6A is a perspective view of patterns of conductive material applied to layers of the substrate. In one embodiment, either SRR patterns 400 (FIG. 4A), SSRR patterns 430 (FIG. 4B), or SR patterns 460 (FIG. 4C) are formed on a first layer of the substrate 602. Thin parallel wire patterns 480 (FIG. 4D) are formed on a second layer of the substrate 604. Then, alternating, either SRR patterns 400 (FIG. 4A), SSRR patterns 430 (FIG. 4B), or SR patterns 460 (FIG. 4C) are formed on a third layer of the substrate 606, and so on. On the first layer of substrate 602 and the third layer of the substrate 606, patterns 608 of conductive material, whether SRR patterns 400 (FIG. 4A), SSRR patterns 430 (FIG. 4B), or SR patterns 460 (FIG. 4C), are depicted only by their orientation, 424, 454, and 478 (FIGS. 4A, 4B, 4C), respectively, for the sake of visual simplicity in FIGS. 6A through FIG. 6I. On the second layer of substrate 604, elements 610 of the thin parallel wire pattern 480 (FIG. 4D) are shown as they would be oriented. On the third layer of substrate 606, additional patterns 608 of conductive material are formed in the same orientation as used on the first layer 602.

In another embodiment not shown, at the block 516 either SRR patterns 400 (FIG. 4A), SSRR patterns 430 (FIG. 4B), or SR patterns 460 (FIG. 4C) are formed on a first side of a substrate layer and thin parallel wire patterns 480 (FIG. 4D) are formed on a second side of the same substrate layer, forming double-sided layers. After the conductive patterns are formed, blank spacer layers are inserted between the double-sided layers. The blank spacer layers are composed of a nonconducting material which can be the same as the substrate layers or a different material. The presence of the blank spacer layers is to adjust an effective dielectric constant of a resulting composite structure, thereby changing a frequency and a bandwidth of a left-handed pass band.

Figure 6B:
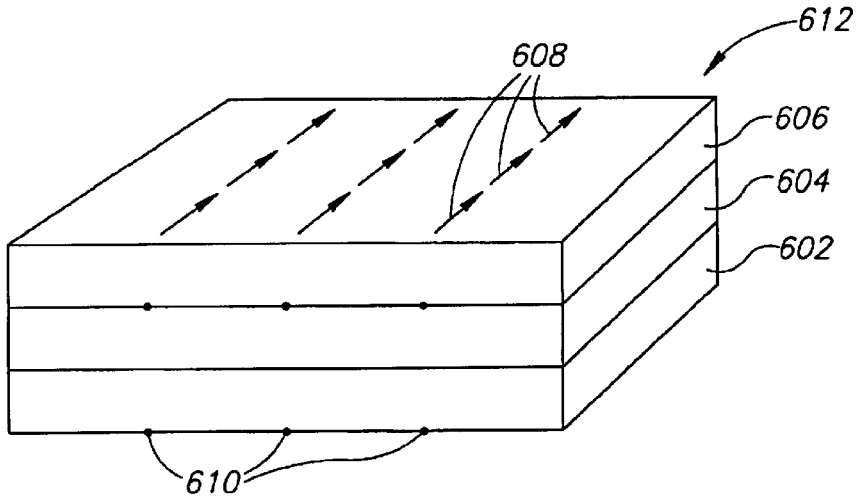
FIG. 6B is a perspective view of the layers of substrate bearing patterns of conductive material of FIG. 6A joined into a block.

Returning now to FIG. 5, at a block 520 alternating layers of the substrate 602, 604, and 606 (FIG. 6A) bearing the conductive patterns are attached together to form a block 612, as shown in FIG. 6B. In a process known to one ordinarily skilled in the art, the layers of the substrate are joined using a glue material (not shown) having material properties similar to those of the chosen substrate and/or spacer layer. For example, to attach layers of substrate consisting of polymide, liquid polymide could be used. Similarly, for Teflon substrates, a liquid Teflon or laminate Teflon material can be used, or a liquid polystyrene could be used for polystyrene substrates. The object is to choose a glue material having as close as possible to the same chemical and physical composition as the substrate itself to create a largely homogenous block 612.

Alternatively, if quartz or glass is used as the substrate, standard bonding techniques suitably are used. Such standard bonding techniques rely on the creation of surface charged layers that do not require the use of a glue or adhesive. In addition, instead of bonding layers to each other, an encapsulating material transparent to incident electromagnetic fields suitably may be used to hold the layers together.

In any case, an object in a method for joining the layers is to avoid thermal expansion mismatches and similar problems that could result if the physical properties of a glue material or encapsulating material did not match that of the substrate itself. The attachment process itself will be achieved by curing the stacked and glued imprinted layers of the substrate to create the solid block 612. As shown in FIG. 6B, ends of the thin parallel wire pattern elements 610 can be engaged at edges of the block 612.

Figure 6C:
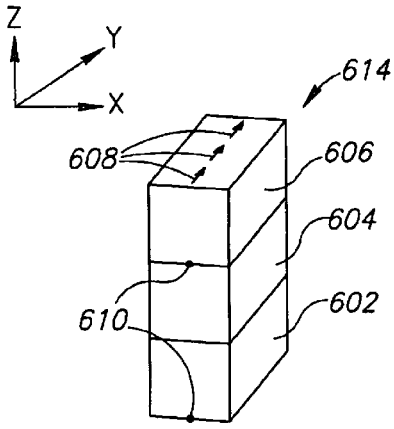
FIG. 6C is a perspective view of a slice of the block of the patterns of conductive material and substrate of FIG. 6B.

At a block 524, to prepare layers for creation of the next set of patterns of conductive materials, the block 612 formed at the block 520 is sliced. Slices are made between the patterns 608 and the thin parallel wire elements in a Y-Z plane (according to the perspective of FIG. 6B) where the layers are stacked along a Z axis and the thin parallel wire elements 610 and the other elements 608 extend parallel to a Y axis. Referring to FIG. 6C, the resulting slices have an appearance of a slice 614. In the slice 614, segments of the substrate layers 602, 604, and 606 are still visible, as are the patterns 608 of the conductive materials formed on the third layer 606 and the ends of the thin parallel wire elements 610.

Figure 6D:
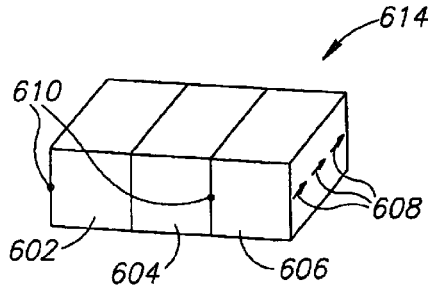
FIG. 6D is a perspective view of the slice of FIG. 6B rotated clockwise ninety degrees about the Y axis.

Once the slices 614 have been created at the block 524 (FIG. 5), at a block 528 each of the slices is rotated to present a layer for the formation of the next group of patterns of conductive material. As described at the block 528 and shown in FIG. 6D, each of the slices formed at block 524 are rotated about the Y axis to present the next face to be used for the formation of conductive patterns. FIG. 6D shows, as can be seen from the relative positions of segments of layers 602, 604, and 606, the conductive patterns 608, and the thin parallel wire elements 610, that the slice 614 of FIG. 6C has been rotated ninety degrees clockwise about the Y axis. As also can be seen in FIG. 6D, this rotation of the slice 614 presents a clean face for formation of another set of conductive patterns.

Figure 6E:
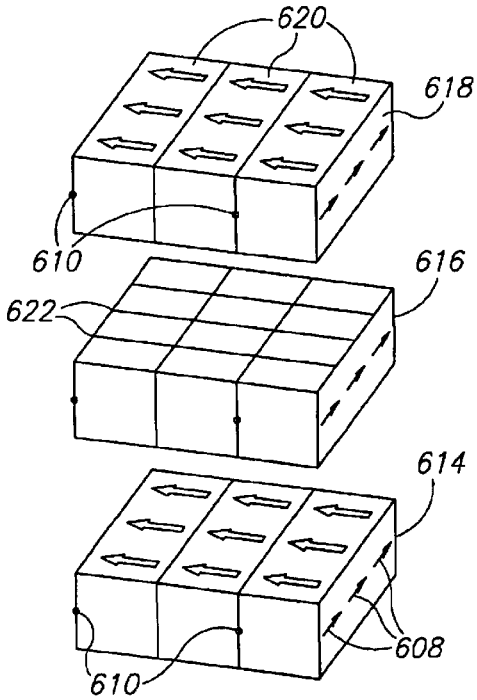
FIG. 6E is a perspective view of additional patterns of conductive material applied to slices as shown in FIG. 6D.

Beginning with a block 532 of FIG. 5, the process represented by blocks 512 through 528 now largely repeats with regard to the layers formed in the preceding steps with a few differences, as will be explained. At the block 532, the second layers, which include slices formed and rotated such as the slice 614 of FIG. 6D, are prepared for the deposition of conductive materials using known means. At a block 536, using the same methods previously described in connection with block 516, conductive materials are deposited and then etched to form conductive patterns. As shown in FIG. 6E, these patterns are formed on layers such as the slice 614, shown in FIG. 6D, and similar layers 616 and 618. Alternatively, the thin parallel wire patterns 622 suitably are formed on a second face of the layers 614 and 618, and the layer 616 can be replaced by a blank spacer layer.

FIG. 6E shows a difference between the blocks 516 and 536 in the orientation of the conductive patterns formed. The SRR patterns 400 (FIG. 4A), SSRR patterns 430 (FIG. 4B), or the SR patterns 460 (FIG. 4C) are now oriented as shown by the double arrows 620 shown in FIG. 6E, representing the patterns. As one views FIG. 6E, this orientation is parallel to an X axis and directed from right to left, or directed from a conventional positive value of an X variable toward a conventionally negative value of X. Second thin parallel wire element patterns 622 are aligned parallel with the alignment of the patterns 620. As one can see from FIG. 6E, the newly-formed patterns 620 and 622 run perpendicular to the first formed patterns 608 and 610.

Figure 6F:
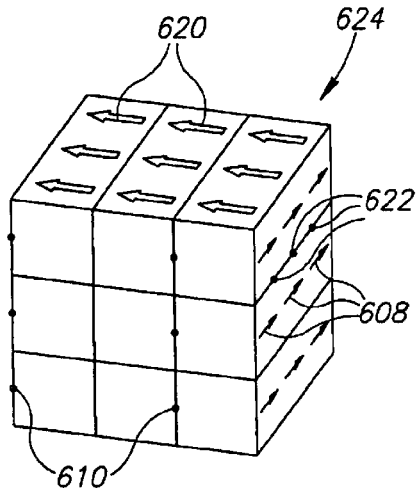
FIG. 6F is a perspective view of the layers of substrate bearing patterns of conductive material of FIG. 6E joined into a block.
Figure 6G:
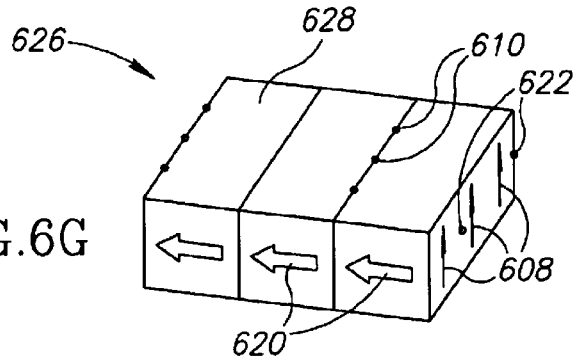
FIG. 6G is a perspective view of a slice in the X-Z plane of the block of FIG. 6F rotated counterclockwise ninety degrees about the X axis.

At a block 540 (FIG. 5), the imprinted layers 614, 616, and 618 are now joined into a block 624, using a process like that described in connection with step 520. The block formed is shown in FIG. 6F. Also, comparable with the process described at block 524, at a block 544 the block 624 is now sliced to form layers to be used for the further imprinting of conductive patterns. A difference between the blocks 524 and 544, comparable to the difference between the deposition blocks of 516 and 536, is one of orientation. At the block 544, the block 624 is sliced to form new layers. The difference between the blocks 524 and 544 is that the conductive patterns formed at block 536 run parallel to an X-axis, while those that are formed at the block 516 run parallel to the Y-axis. Thus, the slices are made in an X-Z plane. The resulting slice is then rotated about its X-axis (block 548 of FIG. 5) to form a slice 626 shown in FIG. 6G. The slice 626 shows a blank surface 628, ready to be imprinted with conductive patterns. Although the slice 626 has the remaining blank surface 628, it will be appreciated that, perpendicular to an X-Y plane containing the surface 628 are patterns 608 and 610, and parallel to that plane are patterns 620 and 622.

Figure 6H:
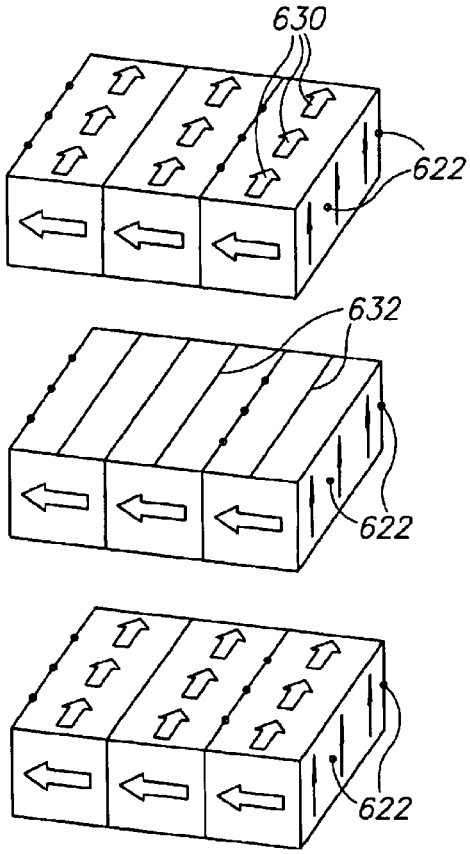
FIG. 6H is a perspective view of additional patterns of conductive material applied to slices as shown in FIG. 6G.
Figure 6I:
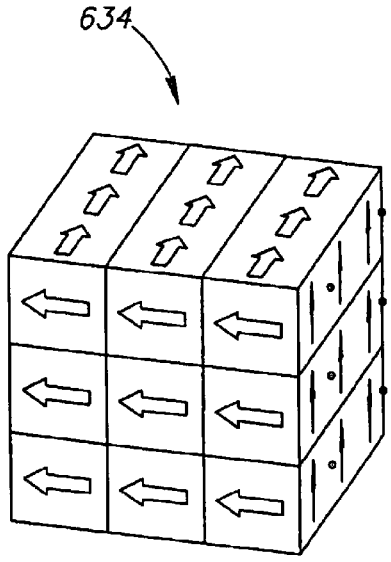
FIG. 6I is a perspective view of the layers of substrate bearing patterns of conductive material of FIG. 6H joined into a block.

A last phase of the process begins at a block 552 (FIG. 5) in which layers are again prepared, as previously referenced, for the deposition of conductive materials. At a block 556, conductive patterns are formed on these layers through the deposition and etching process previously described in connection with the blocks 516 and 536. Again, a difference is one of orientation. As shown in FIG. 6H, a third grouping of conductive patterns, SRR patterns 400 (FIG. 4A), SSRR patterns 430 (FIG. 4B), or SR patterns 460 (FIG. 4C) are formed, oriented as shown by the triple arrows 630 shown in FIG. 6H, representing the patterns. The orientation is directed along the Y-axis. Thin parallel wire pattern elements 632 are also oriented as shown, parallel with the Y-axis. Comparable with steps at the blocks 520 and 540 (FIG. 5), at a block 560 imprinted layers are now joined, as shown in FIG. 6I, into a block 634. This block now represents a completed unit of three-dimensional meta-material.

A variation of the first embodiment of a method for making meta-materials is described in FIG. 7, and FIGS. 8A through 8D show perspective views of meta-materials being created thereby. An object of this variation is creating a similar structure supporting a plurality of conductive patterns, but in a manner in which the underlying substrate can be removed to create a resulting structure having reduced weight. To this end, conductive patterns are formed not on the substrate directly, but on layers of a binding material or binder applied to the layers of substrate, with the layers of substrate material subsequently being etched away or otherwise removed. Many of the steps are similar to steps 505 through 560 as shown in FIG. 5. In the interest of brevity, details of comparable steps will not be repeated, but differences will be highlighted.

The method begins at a block 704 by choosing a substrate material. The material that is selected for the substrate is suitably a material that can be etched away without disturbing the integrity of the binder, which is explained below. For example, the substrate may be aluminum-based so that it can be dissolved with a weak acid that will not dissolve the binder. Having chosen the substrate at the block 704, at a block 708 the chosen substrate is prepared in layers. At a block 712, any preparatory steps desired for the application of materials to the substrate completed.

At a block 714, the binder is applied to the substrate. The binder may be a thermoplastic, an organic resin, or other material that, in contrast to the substrate material, suitably withstands corrosive effects of the etching material. FIG. 8A is a perspective view representing a layer of the binder 802 being applied to a layer of the substrate 804. At a block 716 (FIG. 7), patterns of conductive materials are then formed on the layer of binder instead of directly on the substrate. FIG. 8B is a perspective view of the substrate layer 802 applied to the substrate layer 804 with a plurality of conductive patterns 808 applied to the binding layer 802. In FIG. 8B, the patterns of the conductive material as shown in FIGS. 4A through 4C for the sake of visual simplicity are represented by a single arrow indicating their orientation.

Figure 8A:
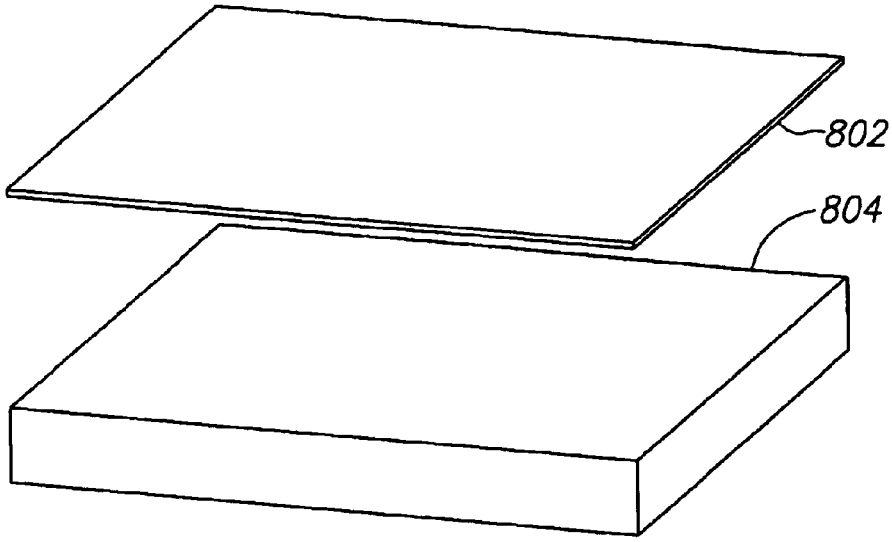
FIG. 8A is a perspective view of a layer of a binding material applied over a substrate.
Figure 8B:
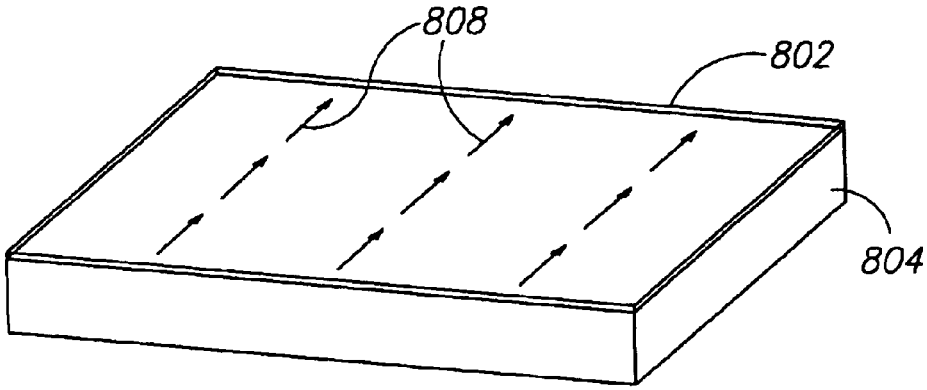
FIG. 8B is a perspective view of patterns of conductive material applied to the layer of the binding material applied over the substrate.
Figure 8C:
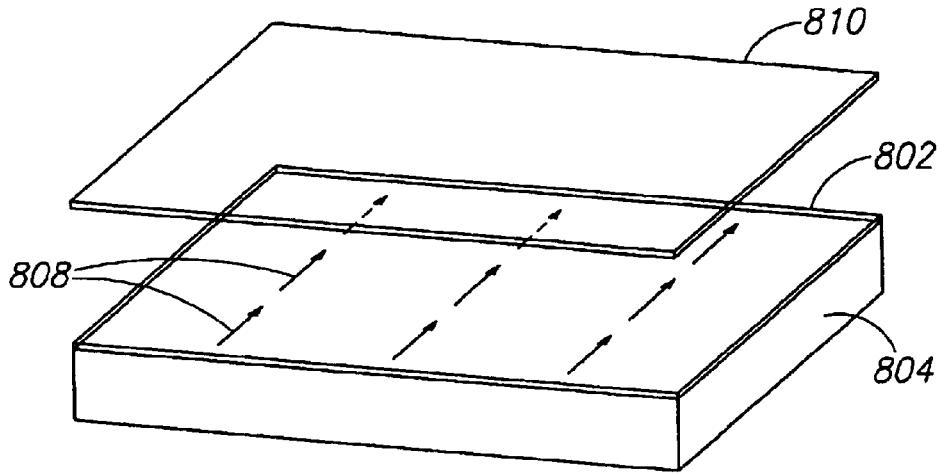
FIG. 8C is a perspective view of a second layer of binding material being applied over patterns of conductive material.
Figure 8D:
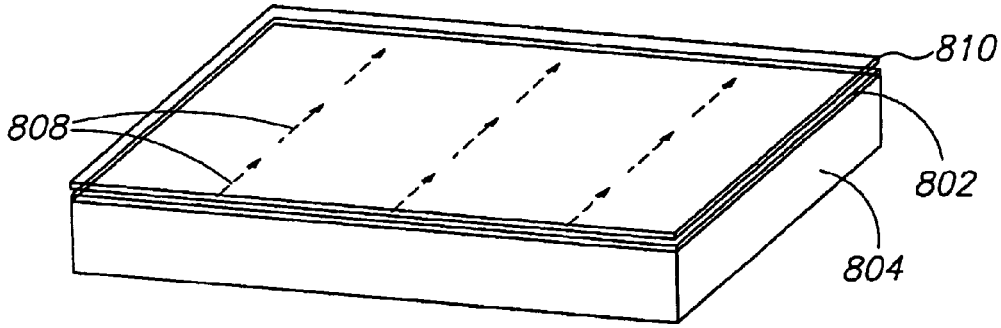
FIG. 8D is a perspective view of a second layer of binding material in place over patterns of conductive material.

At a block 718, a second layer of a binder is applied over the patterns of conductive material. The second layer of binder may be useful to protect the patterns of conductive material, to serve as additional binder in joining the layers as will be described below, or for other purposes. FIG. 8C shows the second layer of binder 810 in the process of being applied over the conductive patterns 808. FIG. 8D shows the second layer 810 in place over the conductive patterns 808. The two layers of binder 802 and 810 effectively seal the conductive patterns in the selected binding material. At a block 719, access holes are then formed in the binder for the purpose of allowing etchant to more easily reach the substrate material when the substrate is subsequently removed. Accordingly, the access holes suitably extend completely through the thickness of the layers of binder to the substrate. Such access holes can be formed by chemical etching, reactive ion etching (RIE), laser drilling, or the like. The access holes may be formed away from the patterns of conductive material to ensure the patterns are not damaged during the formation of the access holes.

At a block 720, alternating layers of the substrate bearing the conductive patterns are attached together to form a block as was done at the block 520 (FIG. 5) and as shown in FIG. 6B. The binder chosen to form the layers may serve as the glue to join the layers, or an additional gluing material can be used as desired. At a block 724, to prepare layers for creation of the next set of patterns of conductive materials, the block formed in the block 720 is sliced. Slices are made between the conductive patterns in a Y-Z plane. At a block 728, each of the slices is rotated about the Y-axis to present a layer for formation of a next group of patterns of conductive material.

Beginning with a block 732, the process represented by blocks 712 through 728 now largely repeats with regard to the layers formed in the preceding blocks with a few differences. At the block 732, the second layers, which include the slices formed and rotated during the preceding steps, are prepared for the deposition of materials using known methods. At a block 734, a binder is applied to the second layers. At a block 736 conductive materials are deposited and then etched to form conductive patterns. The relative orientation of each of these series of conductive patterns is suitably similar to that shown in FIGS. 6A through 6I. At a block 738, a second layer of binder is applied over the conductive patterns. At a block 739, access holes are formed in the layers of the binder. At a block 740 the layers are joined into a block. At a block 744, the block is now sliced to form layers to be used for the further imprinting of conductive patterns. The difference between the blocks 724 and 744, like those steps illustrated in FIGS. 6A through 61, is that the conductive patterns formed at block 736 run parallel to an X-axis. Thus, the slices are made in an X-Z plane. A resulting slice is then rotated about its X-axis to form a slice ready to be layered with binder and imprinted with conductive patterns (block 748 of FIG. 7).

The last phase of the process begins at a block 752 in which layers are again prepared, as previously referenced, for the deposition of materials. At a block 754, a binder layer is applied. At a block 756, conductive patterns are formed on the layers of binder. Again, a difference is one of orientation, as previously described in connection with FIGS. 6A through 6I. At a block 758, a second layer of binder is applied over the conductive patterns. At a block 759, access holes are formed in the layers of binder. Comparable with steps 720 and 740 (FIG. 7), at a block 760 imprinted layers are now joined.

Figure 7A:
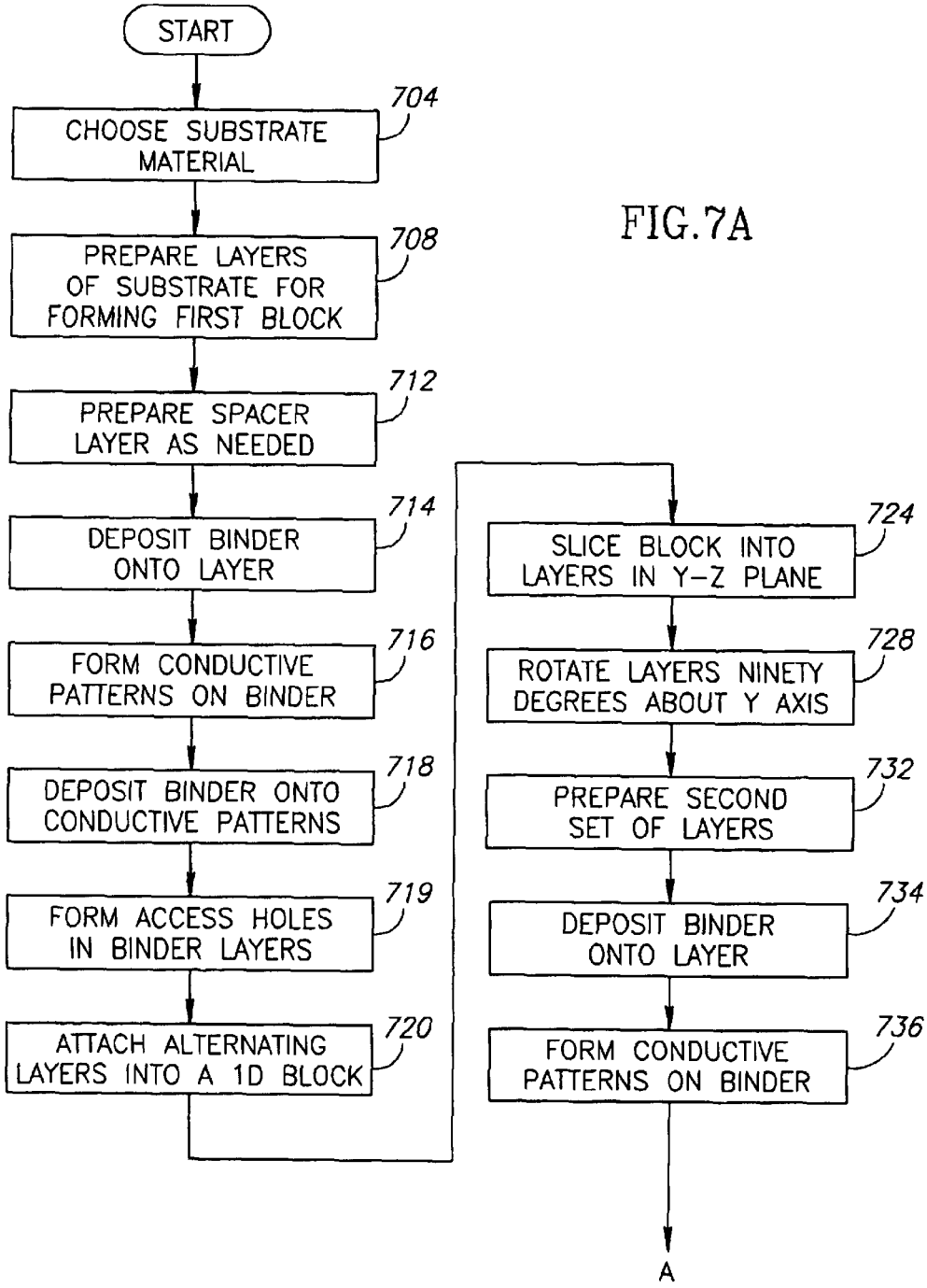
FIG. 7 is a flowchart of a method for making meta-materials in accordance with a variation of the first embodiment of the present invention.
Figure 7B:
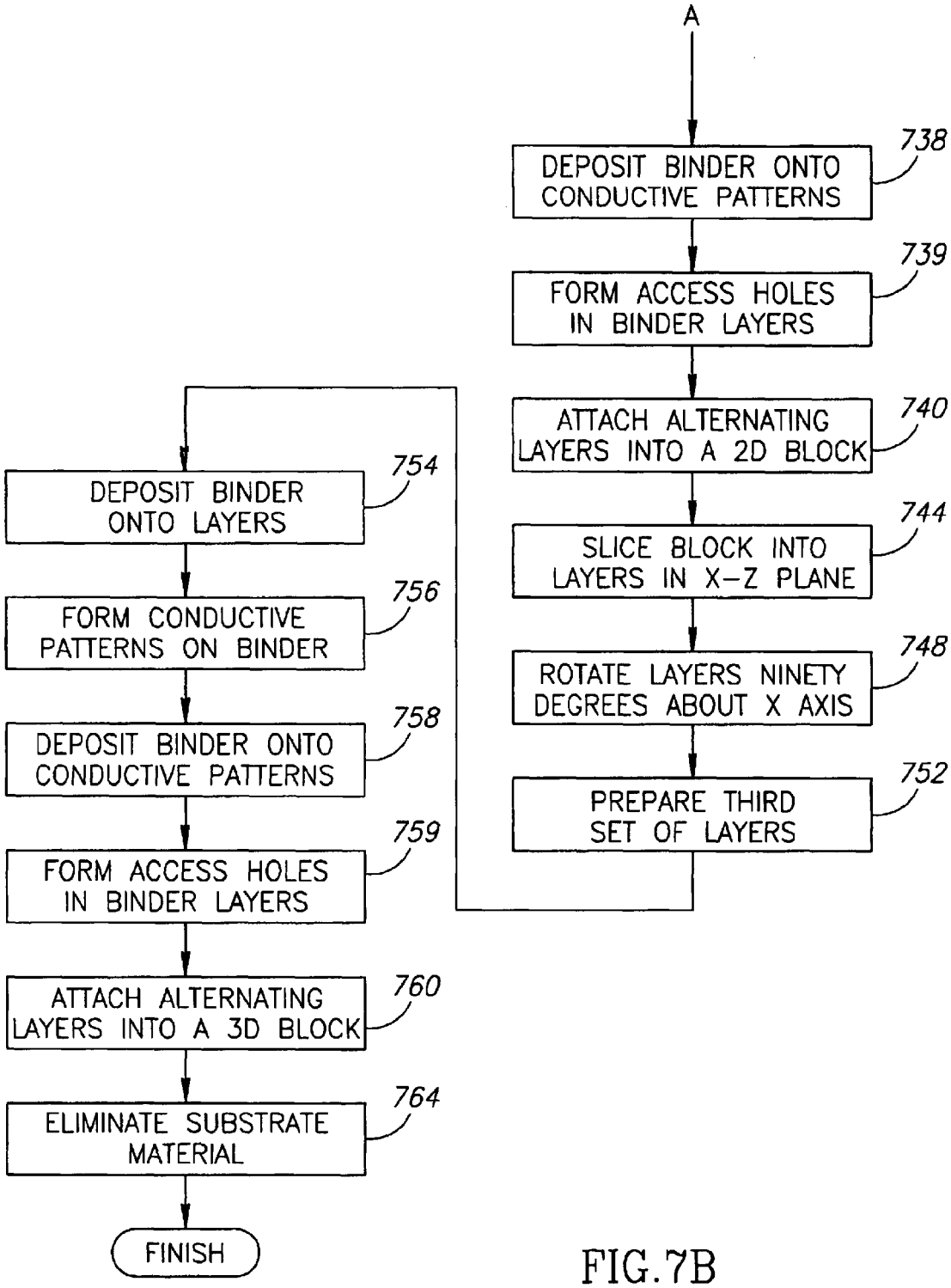

However, as opposed to the process described in connection with FIG. 5, the process described in FIG. 7 is not yet completed. At a block 764, an etchant is now applied to dissolve the substrate. The resulting structure of conductive patterns is suitably the same, but in this variation the conductive patterns are now supported in a honeycombed lattice of layers of binder, without the mass of the substrate material. This honeycombed lattice now represents a completed unit of meta-material according to a variation of the first embodiment of the invention.

Figure 9:
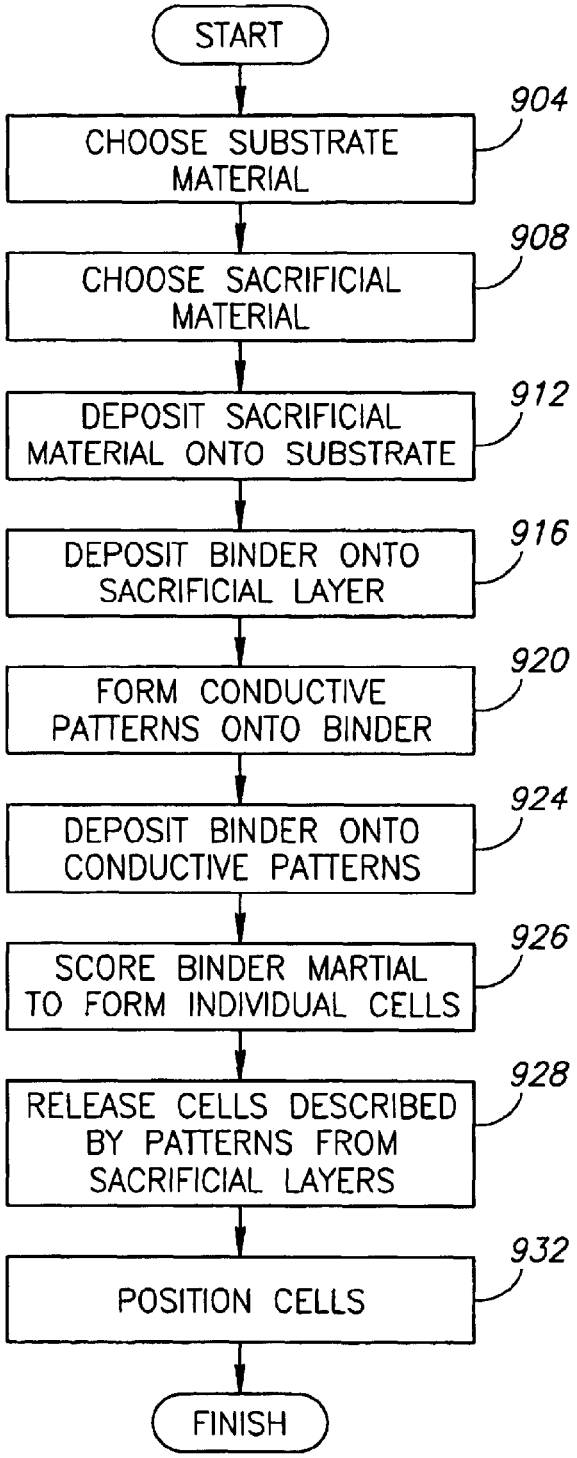
FIG. 9 is a flowchart of a method for making meta-materials in accordance with a second embodiment of the present invention.
Figure 10:
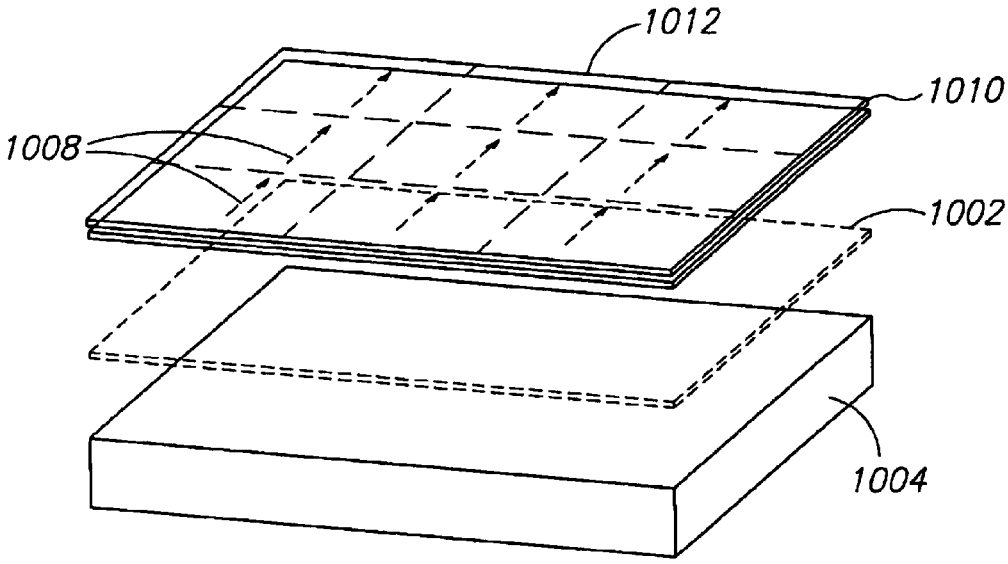
FIG. 10 is an exploded perspective view of patterns of conductive material encased in layers of a binding material, a sacrificial layer, and a substrate.

A second embodiment of the method of the present invention is described in FIG. 9 with arrangement of materials used in the method illustrated in an exploded perspective view of FIG. 10. An object of this second embodiment is to form elements of conductive patterns which may be arranged in ways other than the blocks formed according to the method shown in FIG. 5 or the lattice formed according to the method shown in FIG. 7. In short, conductive patterns are formed in a binder matrix similar to that previously described in FIG. 7. However, in this embodiment, the individual patterns are formed and separated by etching, and then the binder-encased patterns are removed from the substrate for arrangement and installation. The process of the second embodiment does not involve the joining, slicing, and/or rotating of layers as described in the preceding methods of FIGS. 5 and 7.

A process of the second embodiment begins at a block 904 with the selection of a substrate material. The substrate in this embodiment may advantageously be reusable for creating multiple batches of conductive patterns. Accordingly, the substrate material can be chosen for its durability and resilience to chemicals. At a block 908, a sacrificial material is chosen, and the sacrificial material is applied to the substrate at a block 912. The sacrificial material is suitably a dissolvable material which can be etched away to free from the substrate materials applied to the sacrificial layer, as will be explained below. Once the sacrificial layer has been deposited on the substrate at block 912, a first layer of a binder is applied to the sacrificial layer at a block 916. At a block 920, conductive patterns are formed on the first layer of binder using one of the methods previously described. At a block 924, a second layer of binder is applied over the conductive patterns, also as previously described.

FIG. 10 shows the sacrificial layer 1002 as it will be applied to a substrate 1004 beneath a first layer of a binding material 1010. Patterns of conductive material 1008 are applied to the first layer of binder 1010, and the second layer of the binder 1012 is applied over the patterns of conductive material 1008.

Once the layers shown in FIG. 10 have all been formed upon the substrate 1004, the binder supporting the cells comprised of binder material 1010 and 1012 and patterns of conductive material 1008 is scored at a block 926 to separate the cells from one another. The cells are then freed from the substrate at a block 928 (FIG. 9). The cells can be freed in a number of ways. For one non-limiting example, the sheets of binder 1010 and 1012 encasing a plurality of patterns of conductive material can be freed by applying an etchant to dissolve the sacrificial layer. This frees the first layer of binding material 1010 from the substrate, leaving the binder layers 1010 and 1012 encasing the patterns of conductive material. The layers 1010 and 1012 can then be sliced between the patterns of conductive materials to create individual cells. For a second non-limiting example, the layers of binder 1010 and 1012 and the sacrificial layer 1002 are suitably etched away between the conductive patterns 1008. Subsequently, another etchant corrosive to the sacrificial layer 1002 is suitably applied to free the cells.

Figure 11:
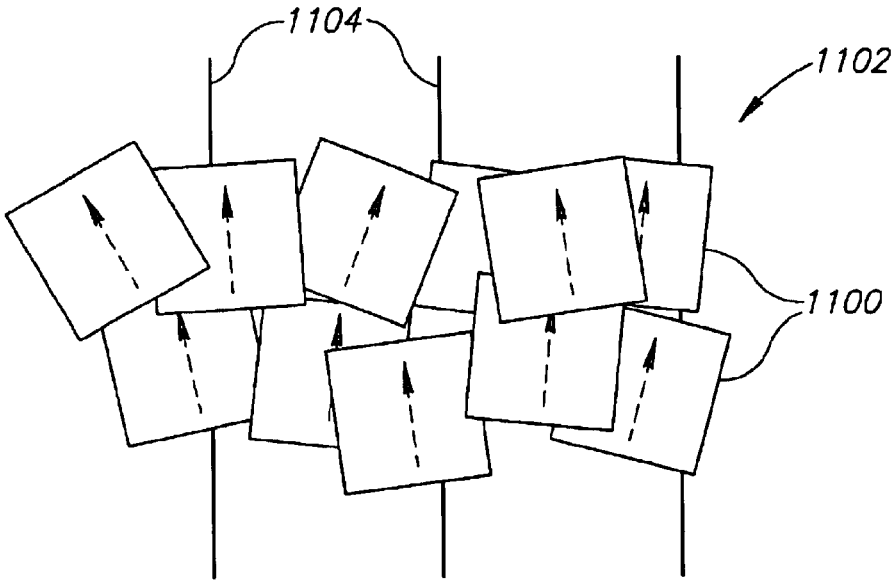
FIG. 11 is a perspective view of elements comprised of individual patterns of conductive material formed on either or both faces bound together in a solid mass.

Once the cells are freed, they can be arranged in a number of ways as desired. FIG. 11 shows an amorphous arrangement of individual cells 1100. The cells 1100 can be joined in a mass 1102 with a binding material (not shown) in a common orientation as shown, or in a more random arrangement. Wire elements 1104 can be arrayed near or within the mass to engage the cells 1100. A structure similar to the foregoing amorphous arrangement of cells is achievable by forming a split ring resonator pattern 400 (FIG. 4A), a square split ring resonator pattern 430 (FIG. 4B), or a swiss roll pattern 460 (FIG. 4C) on one side of a substrate and a thin wire pattern 484 (FIG. 4D) can be formed on an opposite side of the substrate such that separate wire elements 1104 need not be included.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A method for producing meta-materials, the method comprising:

applying a first array of electromagnetically reactive patterns of conductive material to a first non-conducting surface, wherein the first array of electromagnetically reactive patterns includes at least one of a split ring resonator pattern, a square split ring resonator pattern, and a swiss roll pattern;

applying a second array of electromagnetically reactive patterns of conductive material to a second non-conducting surface, wherein the second array of electromagnetically reactive patterns includes a thin parallel wire pattern;

joining each of the first and second surfaces together such that the first and second arrays of electromagnetically reactive patterns are commonly oriented to form a block;

dividing the block between elements of the first and second arrays of electromagnetically reactive patterns along a plane approximately perpendicular to the first and second surfaces to form a plurality of slices;

rotating at least one of the slices to present a third surface; and applying a third array of electromagnetically reactive patterns of conductive material to the third surface.

2. The method of claim 1, wherein the first non-conducting surface is on a first non-conducting substrate and the second non-conducting surface is on a second non-conducting substrate.

3. The method of claim 1, wherein the first non-conducting surface is on a first side of a non-conducting substrate and the second non-conducting surface is on a second opposing side of the non-conducting substrate.

4. The method of claim 1, wherein the first non-conducting surface is on a first non-conducting substrate and the second non-conducting surface is on a second non-conducting substrate, the method further comprising forming at least one spacer layer disposed between the first and second non-conducting surfaces.

5. The method of claim 1, further comprising varying effective properties of the first and second arrays of electromagnetically reactive patterns by changing widths of conductive areas of the electromagnetically reactive patterns.

6. The method of claim 1, further comprising varying effective properties of the first and second arrays of electromagnetically reactive patterns by changing a distance between conductive areas of the electromagnetically reactive patterns.

7. The method of claim 1, further comprising varying effective properties of the first and second arrays of electromagnetically reactive patterns by applying ferromagnetic material to the electromagnetically reactive patterns.

8. The method of claim 7, further comprising changing effective properties of the electromagnetically reactive patterns by applying a magnetic field to an area containing the electromagnetically reactive patterns.

9. The method of claim 1, wherein the first non-conducting surface is on a first non-conducting substrate and the second non-conducting surface is on a second non-conducting substrate, the method further comprising forming at least one spacer layer disposed between the first and second non-conducting surfaces, and varying effective properties of the first and second arrays of electromagnetically reactive patterns by changing a thickness of at least one of the first non-conducting substrate material, the first non-conducting substrate material, and the spacer layer.

10. The method of claim 1, wherein the first non-conducting surface is on a first non-conducting substrate and the second non-conducting surface is on a second non-conducting substrate, the method further comprising forming at least one spacer layer disposed between the first and second non-conducting surfaces, and varying effective properties of the first and second arrays of electromagnetically reactive patterns by changing a dielectric property of at least one of the first non-conducting substrate material, the first non-conducting substrate material, and the spacer layer.

11. The method of claim 1, further comprising applying a first layer of a binding material to the first non-conducting surface, and applying the first array of the electromagnetically reactive patterns over the first layer of binding material.

12. The method of claim 11, further comprising forming a plurality of holes in the first layer of the binding material such that a solution can pass through the first layer of the binding material to the first non-conducting surface.

13. The method of claim 11, further comprising applying a substrate-dissolving solution such that the first and second non-conducting layers are dissolved.

14. The method of claim 11, further comprising applying a second layer of binding material over the second array.

15. A method for producing meta-materials, the method comprising:

applying a first array of electromagnetically reactive patterns of conductive material to a first non-conducting surface, wherein the first array of electromagnetically reactive patterns includes at least one of a split ring resonator pattern, a square split ring resonator pattern, and a swiss roll pattern;

applying a second array of electromagnetically reactive patterns of conductive material to a second non-conducting surface, wherein the second array of electromagnetically reactive patterns includes a thin parallel wire pattern; and joining the first and second non-conducting surfaces together such that the first and second non-conducting surfaces bearing the first and second arrays of electromagnetically reactive patterns are commonly oriented.

16. The method of claim 15, wherein the joining of the first and second non-conducting surfaces includes joining the first and second non-conducting surfaces to form a block, the method further comprising:

slicing the block between elements of the first and second arrays of electromagnetically reactive patterns in a plane perpendicular to the first and second surfaces to form a plurality of slices;

rotating at least one of the slices; and applying a third array of electromagnetically reactive patterns of conductive material to a third non-conducting surface of the at least one of the slices.

17. The method of claim 15, wherein the joining of the first and second non-conducting surfaces includes joining the first and second non-conducting surfaces to form a block, the method further comprising slicing the block between elements of the first and second arrays of electromagnetically reactive patterns in a plane perpendicular to the first and second surfaces to form a plurality of slices.

18. The method of claim 17, further comprising applying a third array of electromagnetically reactive patterns of conductive material to a third non-conducting surface of at least one of the slices.

19. The method of claim 15, wherein the first non-conducting surface is on a first non-conducting substrate and the second non-conducting surface is on a second non-conducting substrate.

20. The method of claim 15, wherein the first non-conducting surface is on a first side of a non-conducting substrate and the second non-conducting surface is on a second opposing side of the non-conducting substrate.

21. The method of claim 15, wherein the first non-conducting surface is on a first non-conducting substrate and the second non-conducting surface is on a second non-conducting substrate, the method further comprising forming at least one spacer layer disposed between the first and second non-conducting surfaces.

22. The method of claim 15, further comprising varying effective properties of the first and second arrays of electromagnetically reactive patterns, including at least one of:

changing a width of a conductive area of at least one of the electromagnetically reactive patterns;

changing a distance between conductive areas of at least one of the electromagnetically reactive patterns;

applying a ferromagnetic material to at least one of the electromagnetically reactive patterns; and applying a magnetic field to an area containing at least one of the electromagnetically reactive patterns.

23. The method of claim 1, wherein the first non-conducting surface is on a first non-conducting substrate and the second non-conducting surface is on a second non-conducting substrate, the method further comprising:

forming at least one spacer layer disposed between the first and second non-conducting surfaces; and varying effective properties of the first and second arrays of electromagnetically reactive patterns, including at least one of:

changing a thickness of at least one of the first non-conducting substrate material, the first non-conducting substrate material, and the spacer layer; and changing a dielectric property of at least one of the first non-conducting substrate material, the first non-conducting substrate material, and the spacer layer.

24. The method of claim 15, further comprising applying a layer of a binding material to at least one the first and second non-conducting surfaces, and applying at least one of the first and second arrays of the electromagnetically reactive patterns over the layer of binding material.

25. The method of claim 15, further comprising forming a plurality of holes in the at least one layer of binding material such that a solution can pass through the at least one layer of binding material.

* * * * *